US008337318B2

(12) United States Patent
Oliver

(10) Patent No.: US 8,337,318 B2
(45) Date of Patent: Dec. 25, 2012

(54) TRIPLE/LONG JUMP TAKE-OFF BOARD SYSTEMS AND METHODS FOR FORMING THE SAME

(75) Inventor: Wayne P. Oliver, Delhi, NY (US)

(73) Assignee: Sportsfield Specialties, Inc., Delhi, NY (US)

( * ) Notice: Subject to any disclaimer, the term of this patent is extended or adjusted under 35 U.S.C. 154(b) by 324 days.

(21) Appl. No.: 12/868,001

(22) Filed: Aug. 25, 2010

(65) Prior Publication Data

US 2012/0052962 A1 Mar. 1, 2012

(51) Int. Cl.
*E01C 13/00* (2006.01)
*A63C 13/00* (2006.01)

(52) U.S. Cl. ..... 472/92; 482/15

(58) Field of Classification Search ..... 472/88–94; 446/69, 108, 112, 117; 482/15; 404/1, 43
See application file for complete search history.

(56) References Cited

U.S. PATENT DOCUMENTS

| | | | | |
|---|---|---|---|---|
| 1,084,597 | A * | 1/1914 | Anpt | 446/127 |
| 2,106,105 | A | 1/1938 | Miller | |
| 2,142,305 | A * | 1/1939 | Davis | 52/592.1 |
| 4,004,800 | A | 1/1977 | Hanner | |
| 4,169,688 | A * | 10/1979 | Toshio | 404/40 |
| 4,599,842 | A * | 7/1986 | Counihan | 52/586.2 |
| 4,650,180 | A | 3/1987 | Blondel | |
| 4,824,101 | A * | 4/1989 | Karlas | 482/30 |
| 5,661,937 | A | 9/1997 | Doppler et al. | |
| 6,260,326 | B1 | 7/2001 | Muller-Hartburg | |
| 6,460,583 | B1 | 10/2002 | Lindal | |
| 7,398,623 | B2 | 7/2008 | Martel et al. | |
| 7,540,526 | B2 | 6/2009 | Himmetsberger et al. | |

FOREIGN PATENT DOCUMENTS

| | | |
|---|---|---|
| DE | 3640808 | 3/1988 |
| DE | 2002004015905 | 1/2005 |
| JP | 2002346017 | 12/2002 |
| JP | 2003205060 | 7/2003 |
| JP | 2008194396 | 8/2008 |

OTHER PUBLICATIONS

Sportsfield Specialties 8" Take-Off Board, Model No. TFLT008SS, 1-page, Sep. 2006.
Sportsfield Specialties 12" Take-Off Board Systems, Model No. IAAF/NCAA TFLT012SS, 1-page, Sep. 2006.
Sportsfield Specialties High School 16" Take-Off Board Systems, Model No. TFLT016SS, 1-page, Oct. 2006.

* cited by examiner

*Primary Examiner* — Kien Nguyen
(74) *Attorney, Agent, or Firm* — Heslin Rothenberg Farley & Mesiti P.C.

(57) ABSTRACT

A take-off board system for a triple or long jump generally includes an elongated frame, an elongated take-off board, and a track material member. The frame includes inwardly-extending flanges defining a chamber therein. The take-off board includes a first portion slidably receivable in the chamber of the frame, and a second portion defining an outer take-off surface. The track material member is disposed on an outer surface of the frame. The take-off board system is disposable in a first position in a cavity in the ground with the outer take-off surface of the take-off board disposed even with a track surface, and the take-off board assembly is disposable in a second position in the cavity in the ground with an outer surface of the track material member disposed even with the track surface.

39 Claims, 14 Drawing Sheets

TRIPLE/LONG JUMP TAKE-OFF BOARD SYSTEMS AND METHODS FOR FORMING THE SAME

FIELD OF THE INVENTION

This invention relates generally to take-off boards, and more specifically, to triple and long jump take-off board systems.

BACKGROUND OF THE INVENTION

Conventional triple and long jump take-off board systems require an organic or synthetic board to be mounted to one side of an aluminum tray insert while the other side is typically spray coated in standard track material on-site by the track installer. The organic or synthetic board is typically attached to the tray insert using flat head screws, but only at the longitudinal ends of the board. The flat head screws are then visible to the participants, and because of minimal locations for the screws, warpage of the synthetic or organic board can occur leading to poor aesthetics and potentially dangerous conditions for the athletes. In addition, it is difficult and time consuming to replace the boards once they have been deteriorated by athletes' cleats, exposure to inclement weather, or both.

Sportsfield Specialties 8-inch Take-Off Board, Model No. TFLT008SS comprises a take-off board assembly having a hollow metal tray having attached to one side a synthetic track material, and a take-off board attached to the other side of the hollow metal tray. The take-off board is attached to the metal tray with machine screws.

German Patent No. 3640808 issued to Schaeper discloses a springboard or take-off board comprising a hollow part having covers which may be molded and attached to the hollow part via a wall, and a plurality of flanges having openings therein.

U.S. Pat. No. 2,106,105 issued to Miller discloses a composite plank for use on a boardwalk. The composite plank includes a base of concrete or similar material having a recess in its upper face, and side edges having a cross-sectional dove-tailed shape. The filler such an elongated piece of wood, rubber or other suitable composition has corresponding ends thereof so that when located in the recess of the base, the fillers are keyed therein. The base and the filler are preferably secured together with waterproof cement.

Japanese Patent Publication No. 2008194396 by Sasaki discloses a springboard used for track and field such as long jump and triple jump which has grooves that are arranged in symmetrical position along sides, front and back section, to allow for easy attachment and removal of the springboard. For example, a worker can place a finger into the slots of the springboard to check that installation is proper.

There is a need for further take-off boards, and more specifically, to triple and long jump take-off board systems.

SUMMARY OF THE INVENTION

In a first aspect, the present invention provides a take-off board system for a triple or long jump. The take-off board system generally includes an elongated frame, an elongated take-off board, and a track material member. The frame includes a base, longitudinally and vertically extending sides, and longitudinally and inwardly-extending flanges attached to upper ends of the sides to define a chamber therein. The elongated take-off board comprises a first portion occupying the chamber in the frame which is disposed between inner surfaces of the flanges and inner surfaces of the base adjacent the sides, and comprises a second portion extending above the inner surfaces of the flanges to define an outer take-off surface. The track material member is disposed on an outer surface of the frame. The take-off board system is disposable in a first position in a cavity in the ground with the outer take-off surface of the take-off board disposed even with a track surface, and the take-off board assembly is disposable in a second position in the cavity in the ground with an outer surface of the track material member disposed even with the track surface.

In a second aspect, the present invention provides a take-off board system for a triple or long jump. The take-off board system generally includes an elongated frame, an elongated take-off board, and a track material member. The elongated frame includes longitudinally and inwardly-extending flanges defining a chamber therein. The elongated take-off board includes a first portion slidably receivable in the chamber of the elongated frame, and a second portion defining an outer take-off surface. The track material member is disposed on an outer surface of the elongated frame. The take-off board system is disposable in a first position in a cavity in the ground with the outer take-off surface of the elongated take-off board disposed even with a track surface, and the take-off board assembly is disposable in a second position in the cavity in the ground with an outer surface of the track material member disposed even with the track surface.

In a third aspect, the present invention provides a method for forming a take-off board system for a triple or long jump. The method includes providing an elongated frame comprising a base, longitudinally and vertically extending sides, and longitudinally and inwardly-extending flanges attached to upper ends of the sides to define a chamber therein, providing an elongated take-off board having a first portion and a second portion, sliding the take-off board through an end of the frame so that the first portion occupies the chamber in the frame and is disposed between inner surfaces of the flanges and inner surfaces of the base adjacent the sides, and so that the second portion extends above the inner surfaces of the flanges to define an outer take-off surface, and providing a track material member disposed on an outer surface of the frame.

In a fourth aspect, the present invention provides a method for forming a take-off board system for a triple or long jump. The method includes providing an elongated frame comprising longitudinally and inwardly extending flanges defining a chamber therein, providing an elongated take-off board having a first portion and a second portion, sliding the take-off board through and end of the frame so that the first portion occupies the chamber in the frame, and so that the second portion extends above inner surfaces of the flanges to define an outer take-off surface, and providing a track material member disposed on an outer surface of the frame.

In a fifth aspect, the present invention provides a method for operating a take-off board system for a triple or long jump. The method includes providing an elongated frame having longitudinally and inwardly extending flanges defining a chamber therein, an elongated take-off board having a first portion disposed in the chamber and a second portion extending above inner surfaces of the flanges to define an outer take-off surface, and a track material member disposed on an outer surface of the frame, and allowing the frame and the take-off board to move relative to each other along their length in response to changes in temperature.

In a sixth aspect, the present invention provides a method for operating a take-off board system for a triple or long jump. The method includes providing an elongated frame having longitudinally and inwardly extending flanges defining a chamber therein, an elongated take-off board having a first portion disposed in the chamber and a second portion extending above inner surfaces of the flanges to define an outer take-off surface, and a track material member disposed on an outer surface of the frame, and transferring forces applied to the take-off surface of the take-off board though the elongated take-off board to a base of the take-off board which is disposed on an inner surface of a base of the frame.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

As described in greater detail below, aspects of the present invention reduce, if not eliminate, the need for multiple pieces of hardware for assembling take-off board systems while providing structural support for the synthetic or organic take-off boards. In other aspects, the present invention allows for replacement of the synthetic or organic take-off board. In still other aspects, the design also improves aesthetics of the installed take-off board systems.

Figure 1:
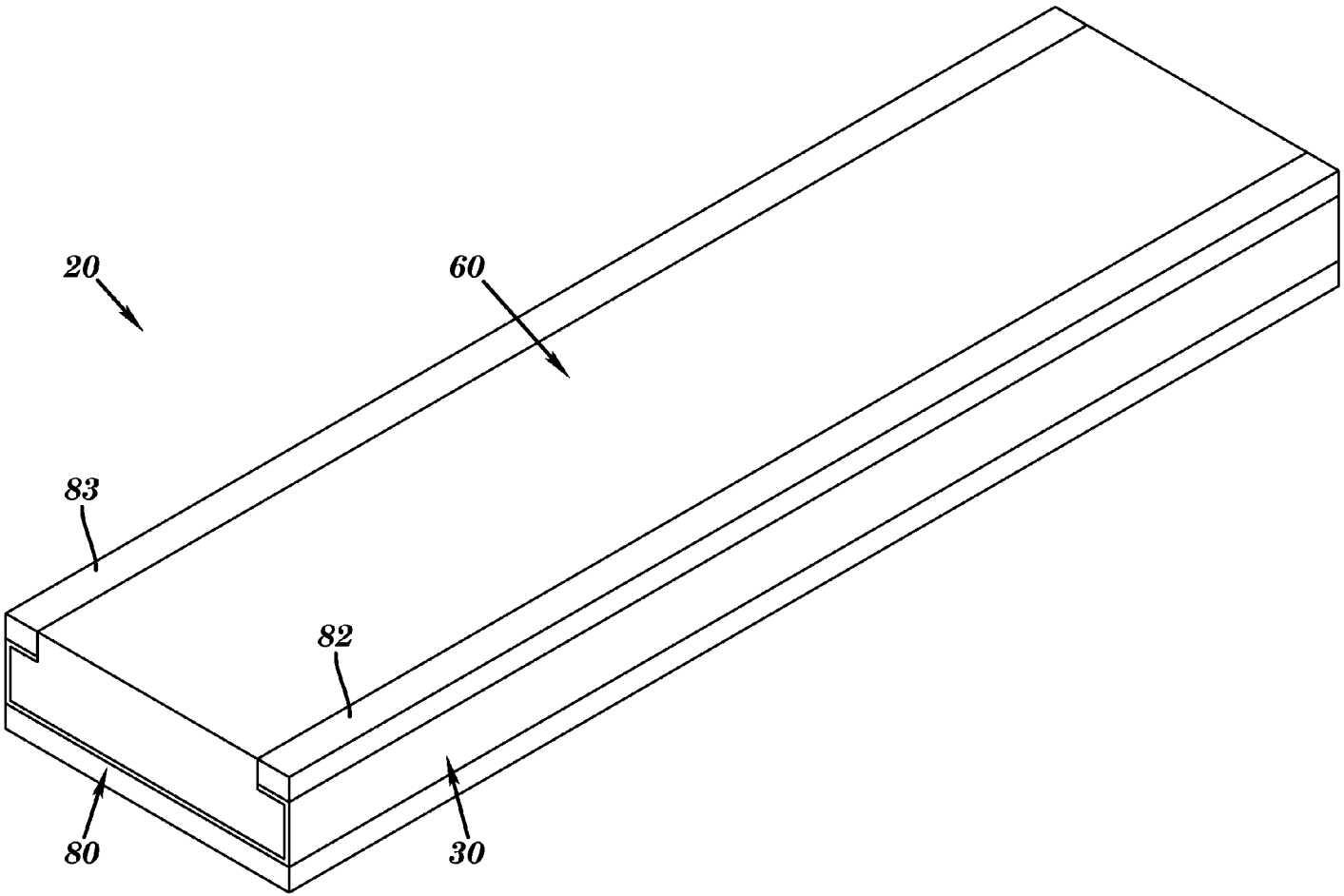
FIG. 1 is a perspective view of one embodiment of a take-off board system in accordance with one aspect of the present invention.

FIG. 1 illustrates one embodiment of a take-off board system 20 for a triple or long jump in accordance with one aspect of the invention. Exemplary take-off board system 20 generally includes an elongated tray or frame 30, an elongated take-off board 60, and a track material member 80.

Figure 2:
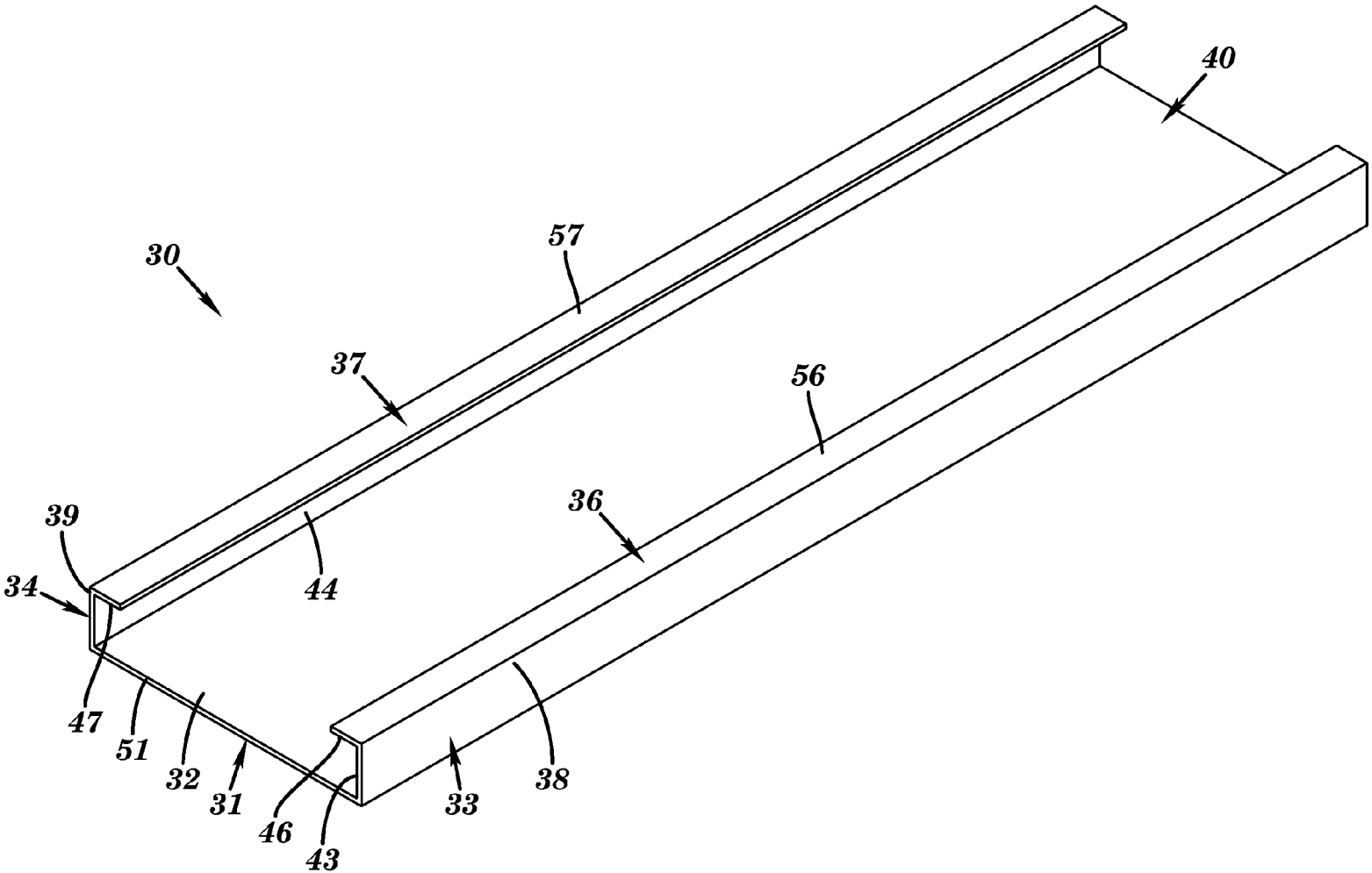
FIG. 2 is a perspective view of the elongated frame having inwardly extending flanges of the take-off board system of FIG. 1.

As best shown in FIG. 2, elongated frame 30 may includes a base 31, longitudinally and vertically extending sides 33 and 34, and longitudinally and inwardly-extending flanges 36 and 37 attached to upper ends 38 and 39 of sides 33 and 34 to define a chamber 40 therein.

Figure 3:
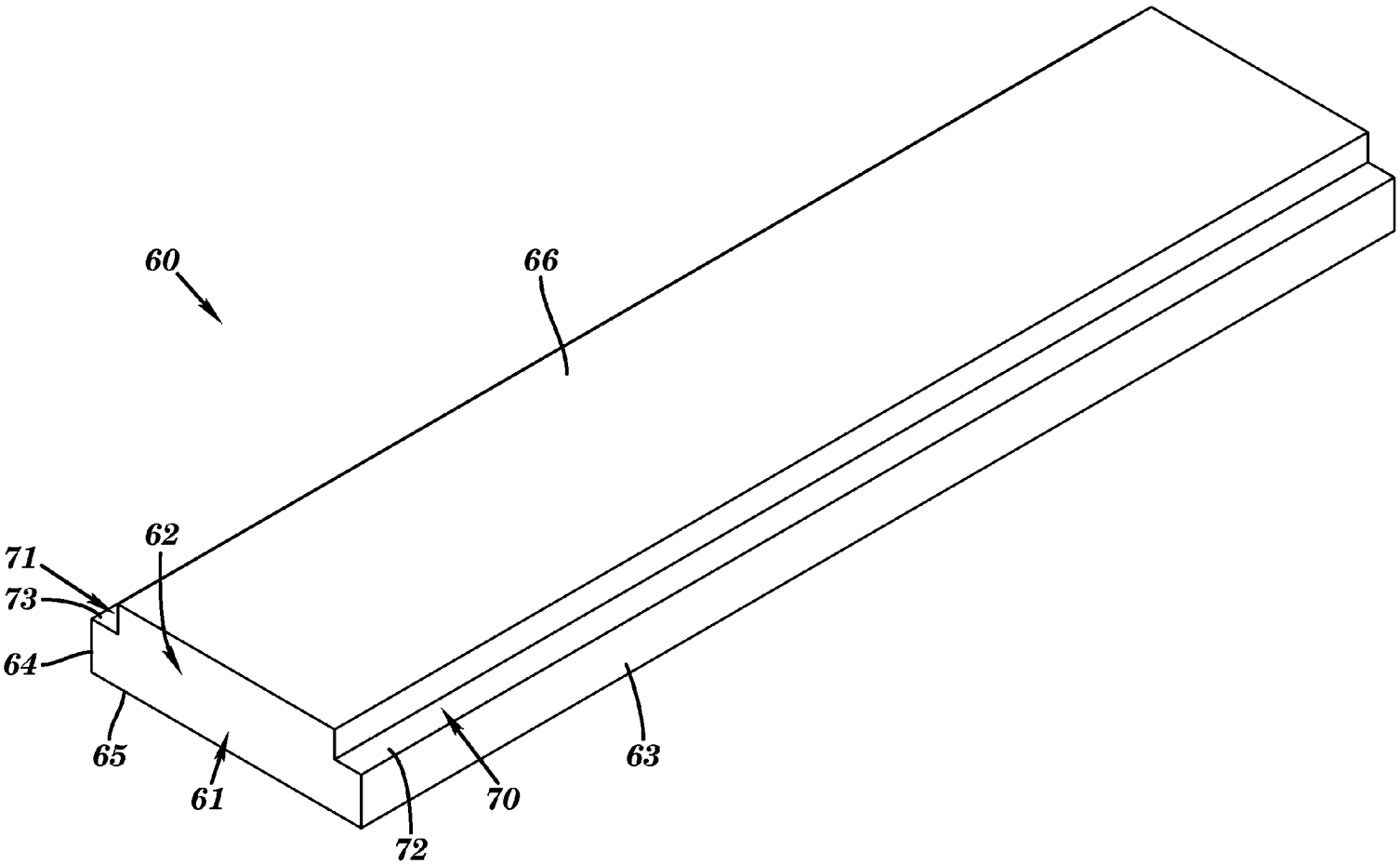
FIG. 3 is a perspective view of the elongated take-off board of the take-off board system of FIG. 1.

As best shown in FIG. 3, elongated take-off board 60 may have first lower elongated portion 61 and a second upper elongated portion 62. For example, elongated take-off board 60 may have a generally rectangular cross-section with notches or cutouts 70 and 71 along the upper elongated corners.

With reference to FIGS. 1-3, elongated take-off board 60 may include first portion 61 occupying chamber 40 in frame 30. For example, first portion 61 may be disposed between first and second sides 33 and 34 of frame 30, and disposed between base 31 and flanges 36 and 37 of frame 30. For example, first portion 61 may include a first longitudinally-extending side 63 and a second longitudinally-extending side 64 disposed adjacent to inner surfaces 43 and 44 of sides 33 and 34, respectively, of frame 30. First portion 61 of elongated take-off board 60 may also include a longitudinally-extending bottom surface 65 disposed adjacent to inner surface 32 of base 31 of frame 30, and horizontal surfaces 72 and 73 disposed adjacent to lower surfaces 46 and 47 of flanges 36 and 37 of frame 30.

Second portion 62 extends above inner surfaces of flanges 36 and 37 to define an outer take-off surface 66. For example, the second portion may extend above the outer surfaces of the flanges. The outer take-off surface may be painted or coated white.

Track material member 80 may be disposed on an outer surface 51 of frame 30. Elongated track material strips 82 and 83 may be disposed along outer surfaces 56 and 57 of inwardly-extending flanges 36 and 37.

The track material member and strips may comprise a synthetic material such as a rubber or rubber-like material. The track material may be a solid member attached to the frame or may be sprayed onto the outer surface of the frame. The track material member and strips may also include an aluminum spacer with a synthetic track material disposed on one side. The track material may be about ½-inch thick.

Figure 4:
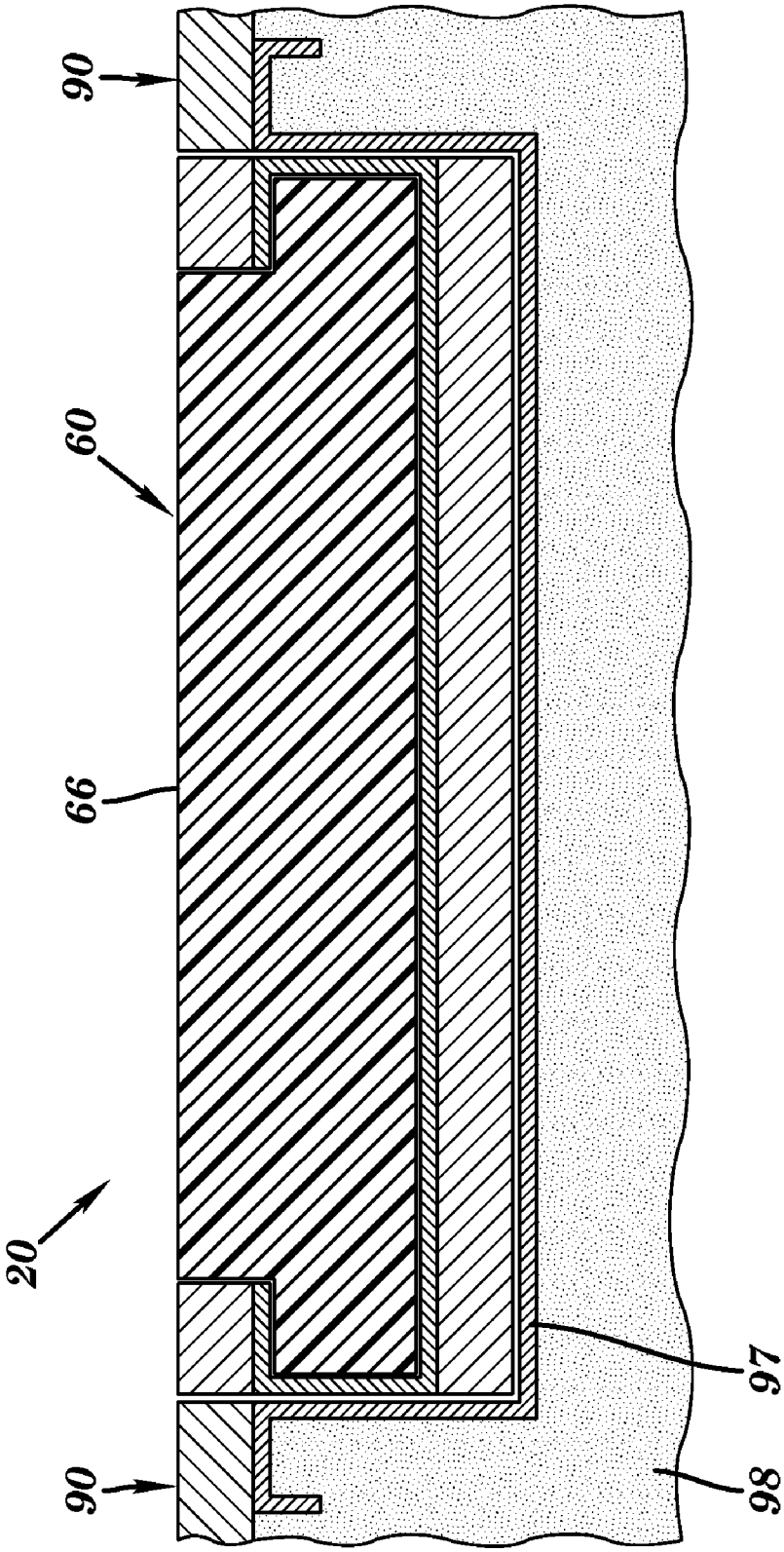
FIG. 4 is an enlarged cross-sectional view of the take-off board system of FIG. 1 disposed in a cavity in the ground, and disposed in a first position with the outer surface of the take-off board disposed even with a track.
Figure 5:
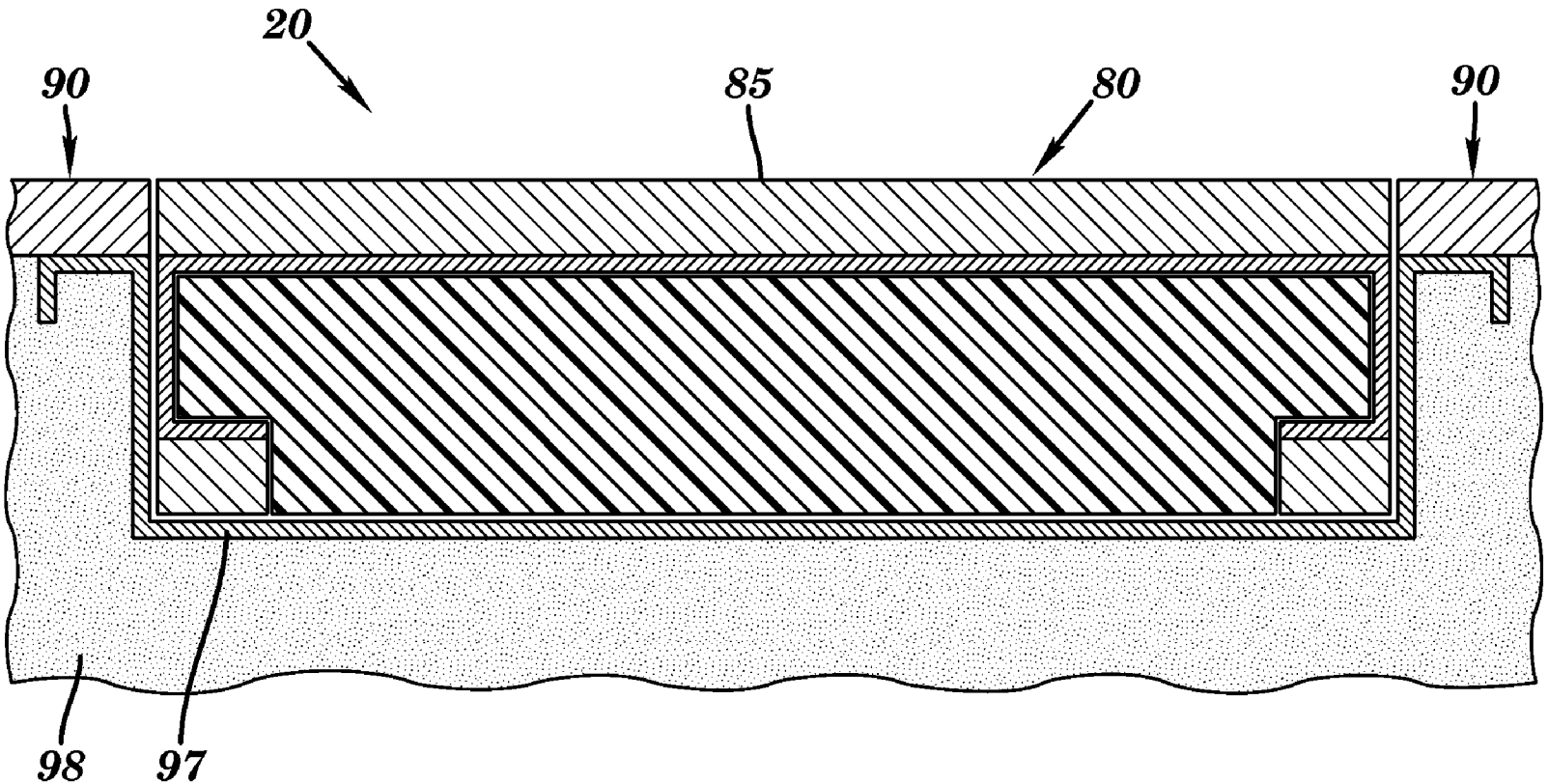
FIG. 5 is an enlarged cross-sectional view of the take-off board system of FIG. 1 disposed in a cavity in the ground, and which is flipped and disposed in a second position with the outer surface of the track material disposed even with the track.

With reference to FIG. 4, take-off board system 20 may be disposed in a first position in a cavity in the ground with outer take-off surface 66 of the elongated take-off board 60 disposed even with a track surface 90. In addition, with reference to FIG. 5, take-off board assembly 20 may be removed from the cavity, flipped, and disposed in a second position in the cavity in the ground with an outer surface 85 of track material member 80 disposed even with track surface 90. The cavity in the ground may be formed using a box 97 such as a metal box. Concrete 98 may be poured around box 97 and cured to hold box 97 in place.

Figure 6:
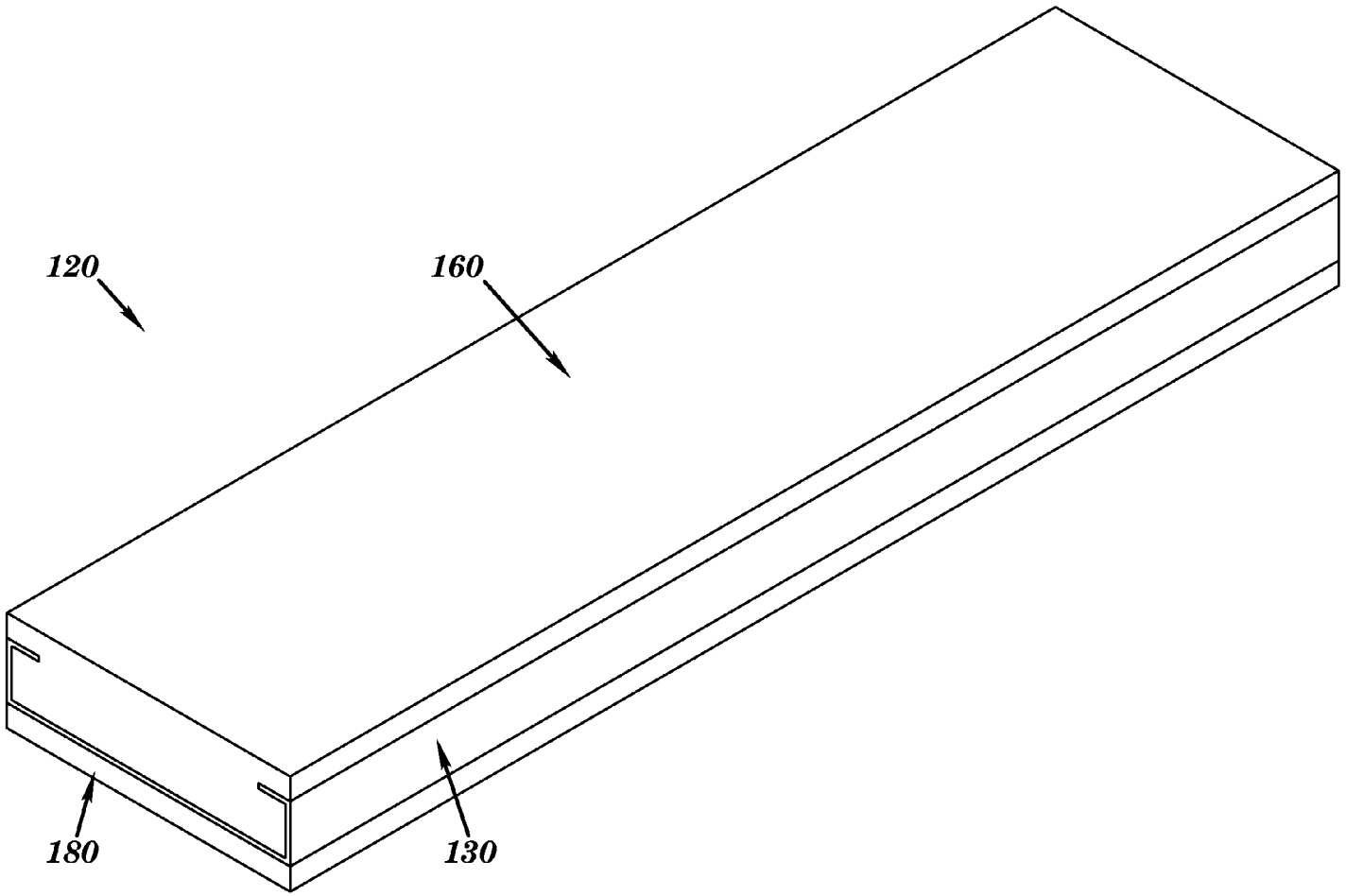
FIG. 6 is a perspective view of another embodiment of a take-off board system in accordance with another aspect of the present invention.

FIG. 6 illustrates another embodiment of a take-off board system 120 for a triple or long jump in accordance with another aspect of the invention. Exemplary take-off board system 120 generally includes an elongated tray or frame 130, an elongated take-off board 160, and a track material member 180.

Figure 7:
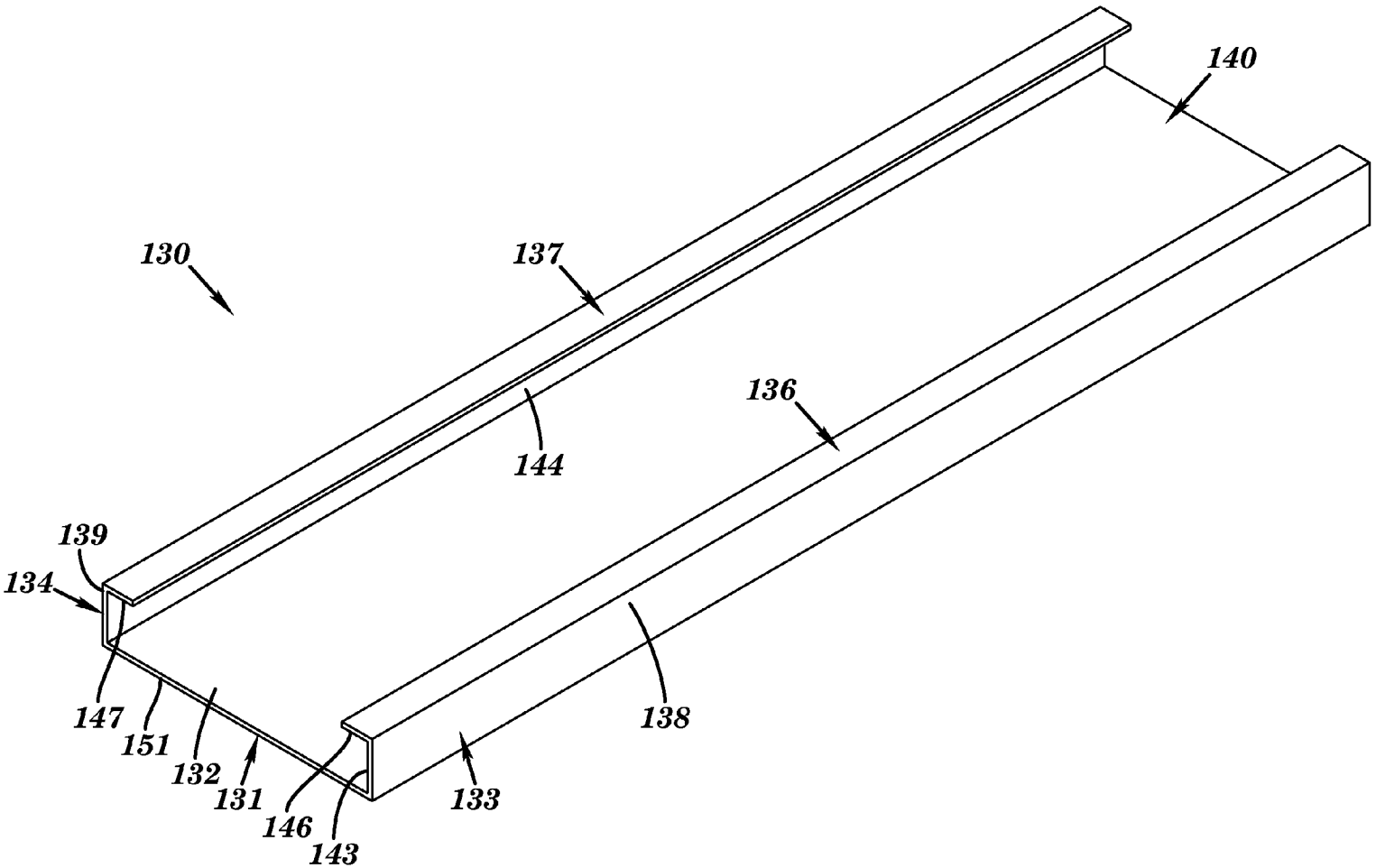
FIG. 7 is a perspective view of the elongated frame having inwardly extending flanges of the take-off board system of FIG. 6.

As best shown in FIG. 7, elongated frame 130 may includes a base 131, longitudinally and vertically extending sides 133 and 134, and longitudinally and inwardly-extending flanges 136 and 137 attached to upper ends 138 and 139 of sides 133 and 134 to define a chamber 140 therein.

Figure 8:
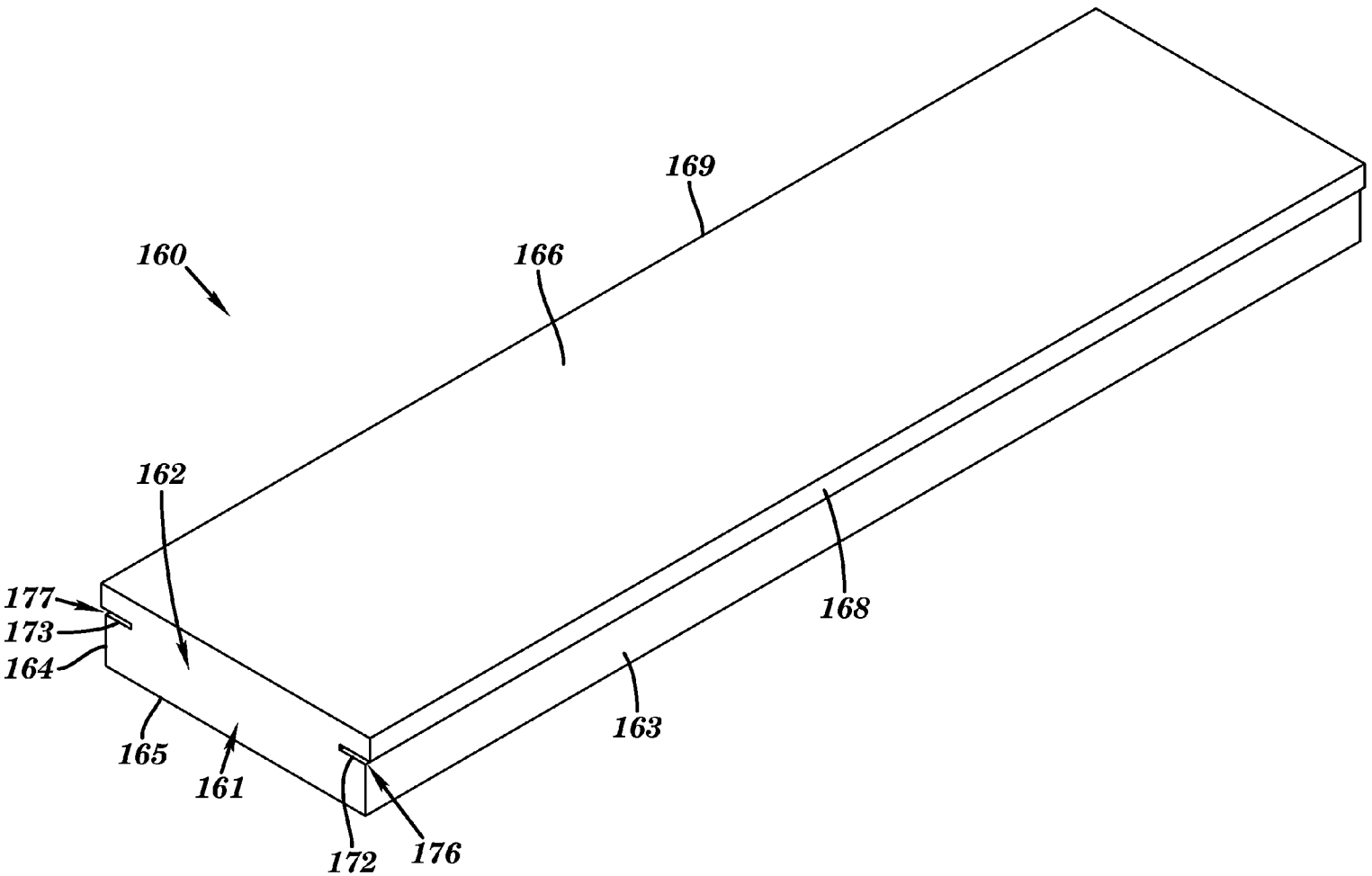
FIG. 8 is a perspective view of the elongated take-off board having elongated longitudinally-extending grooves of the take-off board system of FIG. 6.

As best shown in FIG. 8, elongated take-off board 160 may include a first elongated portion 161 and a second elongated portion 162. Longitudinally-extending grooves 176 and 177 may be disposed along the sides of the elongated take-off board between first elongated portion 161 and a second elongated portion 162.

With reference to FIGS. 6-8, flanges 136 and 137 of frame 130 may be received in the grooves 176 and 177 of elongated take-off board 160. For example, first portion 161 may be disposed between first and second sides 133 and 134 of frame 130, and disposed between base 131 and flanges 136 and 137 of frame 130. For example, first portion 161 may include a first longitudinally-extending side 163 and a second longitudinally-extending side 164 disposed adjacent to inner surfaces 143 and 144 of sides 133 and 134, respectively, of frame 130. First portion 161 of elongated take-off board 160 may also include a longitudinally-extending bottom surface 165 disposed adjacent to inner surface 132 of base 131 of frame 130, and horizontal surfaces 172 and 173 disposed adjacent to lower surfaces 146 and 147 of flanges 136 and 137 of frame 130.

Second portion 162 includes edge portions 168 and 169 which extend above flanges 136 and 137 of frame 130. Second portion 162 defines an outer take-off surface 166. The outer take-off surface may be painted or coated white.

Track material member 180 may be disposed on an outer surface 151 of frame 130. The track material member may comprise a synthetic material such as a rubber or rubber-like material. The track material may be a solid member attached to the frame or may be sprayed onto the outer surface of the frame. The track material member may also include an aluminum spacer with a synthetic track material disposed on one side. The track material may be about ½-inch thick.

Figure 9:
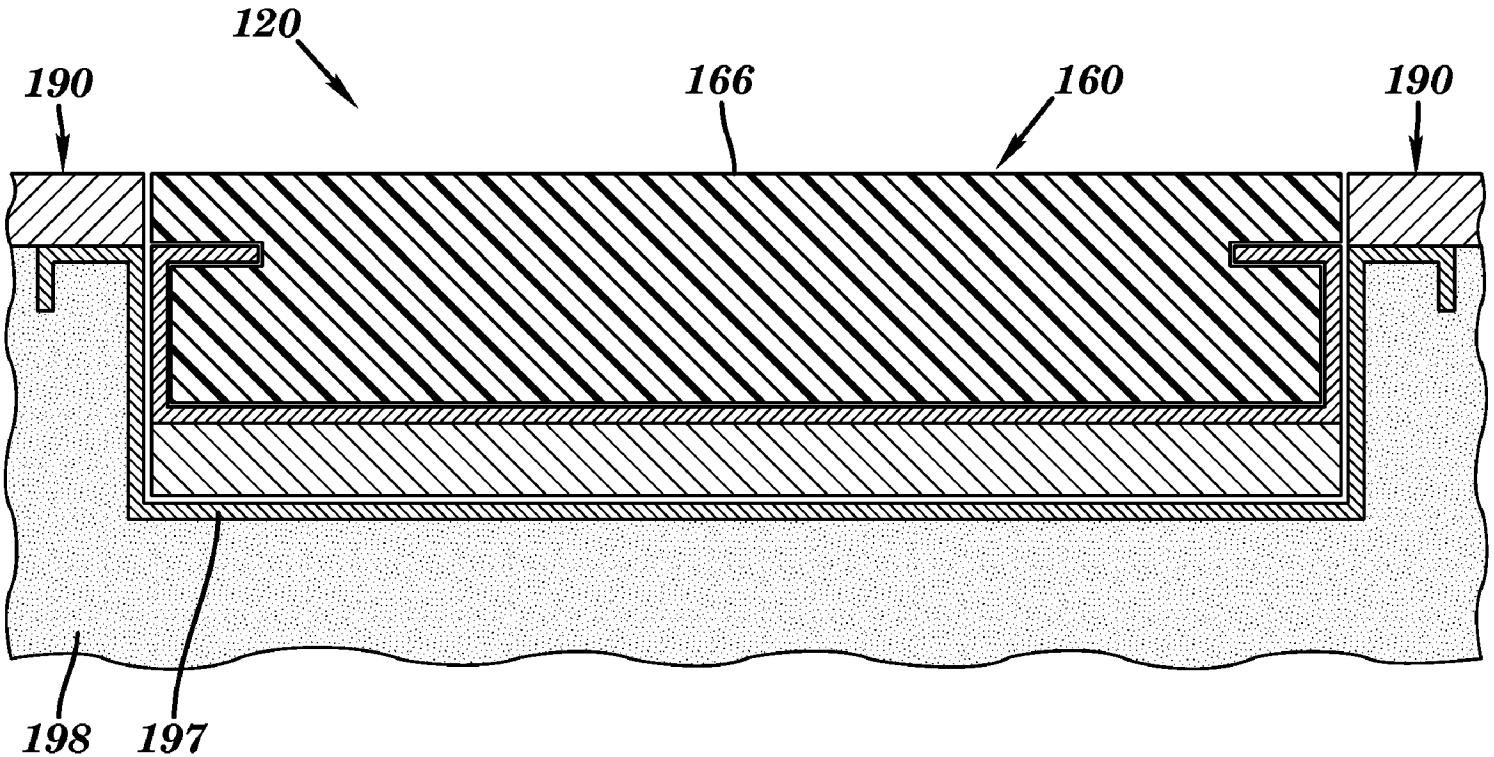
FIG. 9 is an enlarged cross-sectional view of the take-off board system of FIG. 6 disposed in a cavity in the ground, and disposed in a first position with the outer surface of the take-off board disposed even with a track.
Figure 10:
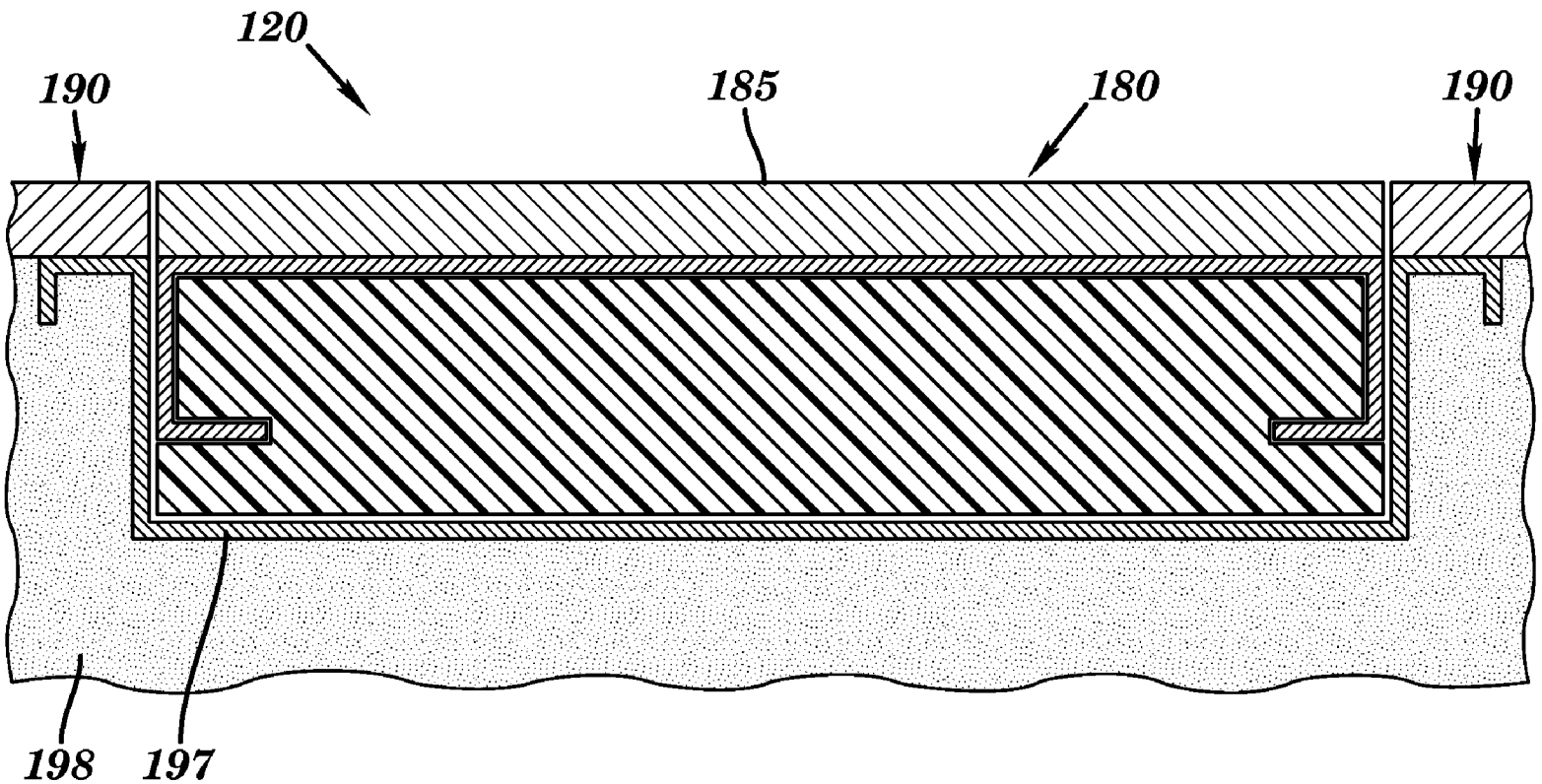
FIG. 10 is an enlarged cross-sectional view of the take-off board system of FIG. 6 disposed in a cavity in the ground, and which is flipped and disposed in a second position with the outer surface of the track material disposed even with the track.

With reference to FIG. 9, take-off board system 120 may be disposed in a first position in a cavity in the ground with outer take-off surface 166 of the elongated take-off board 160 disposed even with a track surface 190. In addition, with reference to FIG. 10, take-off board assembly 120 may be removed from the cavity, flipped, and disposed in a second position in the cavity in the ground with an outer surface 185 of the track material member 180 disposed even with the track surface 190. The cavity in the ground may be formed with box 197 such as a metal box. Concrete 198 may be poured around box 197 and cured to hold box 197 in place.

In an aspect of the present invention, the take-off board systems may allow the take-off boards to be slidably receivable through an end of the elongated frame. In addition, the take-off boards may be slidably maintainable in the elongated frames so that the take-off boards and the elongated frames are movable relative to each other along their length in response to changes in temperature. Thus, differences in thermal expansion of the material forming the take-off boards and the material forming the elongated frames may be accommodated without putting stresses on the take-off board or the elongated frames. The elongated frames may be a metal such as stainless steel such as 16 gauge stainless steel, aluminum, or other suitable material, and the take-off boards may comprise a synthetic material or an organic material such as wood. The longitudinal length of the take-off board systems may be about 48 inches long. The width of the take-off board systems may be about 8 inches, about 12 inches, or about 16-inches wide, and suitable for use in high school and/or college.

From the present description, it will be appreciated that the take-off boards and the elongated frames may be sized and configured so that there is no or little gap or space between the inside of the elongated frame and the outer surface of the take off board. In addition, the take-off boards and the elongated frames may be sized and configured so that the is a slight press fit configuration while allowing thermal expansions may be readily equalized by movement of the take-off boards relative to the elongated frames.

The take-off boards may be solid take-off boards such as a solid organic material such as wood or synthetic material. The take-off boards may comprise a plurality of solid pieces forming a solid board, or a single solid monolithic piece forming the take-off board. It will also be appreciated that the take-off boards may be hollow or comprise hollow portions, e.g., a generally rectangular cross-sectional member having one or more passageways along its length. The take-off boards may be operably machined from a suitable material, e.g., the sides, notches or cutouts, or grooves may be operably machined. In addition, the take-off boards may be molded, and the notches or cutouts, or grooves may be operably machined. Further, the take-off board may be molded to its final shape. The elongated frames may be formed from metal sheet stock and bent to shape. It will be appreciated that other means for fabrication of the take-off boards and elongated frames may be suitably employed.

In one aspect of the invention, the take-off boards support the inner surfaces of the flanges. In another aspect, the take-off boards transfers the forces exerted on the take-off surface by athletes and others, through the take-off board itself directly to the base of the frame, and thus directly onto the bottom of the cavity or box in the ground. Thus, from the present description, the take-off board may comprises various partially hollow configurations, comprising for example ribs, trusses, etc, that allow the transfer of forces exerted on the take-off surface by athletes and others, through the take-off board itself directly to the base of the frame. Such configurations noted above, result in forces exerted on the take-off board to be carried and directly transferred through the board to the bottom of the cavity or box in the ground.

From the above description, an aspect of the present invention eliminates multiple pieces of hardware related to the assembly of take-off board systems while providing structural support for the synthetic or organic take-off board. In addition, one or more second elongated take-off boards may be provided or subsequently purchased and used for replacing worn out elongated take-off board, for example, which have deteriorated by athletes' cleats and/or exposure to inclement weather. The design also improves aesthetics of the installed system minimizing movement of internal tray inside the exterior form.

From the present description, the elongated frame designs capture the elongated take-off boards along their longitudinal length by incorporating internally bent flanges at the top of the frames. The flanges provide support to inhibit, if not eliminate, bowing and warpage while simplifying the overall system design and also simplifying take-off board replacement, if necessary. Instead of the take-off boards being fastened to the tray by screws, a solid synthetic material is simply slid into position from the ends of the frames. This design reduces, if not eliminates, stress points along the take-off boards, allowing the take-off boards to expand and contract without impingement, reducing and minimizing the likelihood of warpage or bowing.

As described above, an aspect of the take-off board systems in accordance with the present invention improves aesthetics of the installed take-off board systems and minimizes movement of the elongated frame inside the exterior form, cavity, or box.

Figure 11:
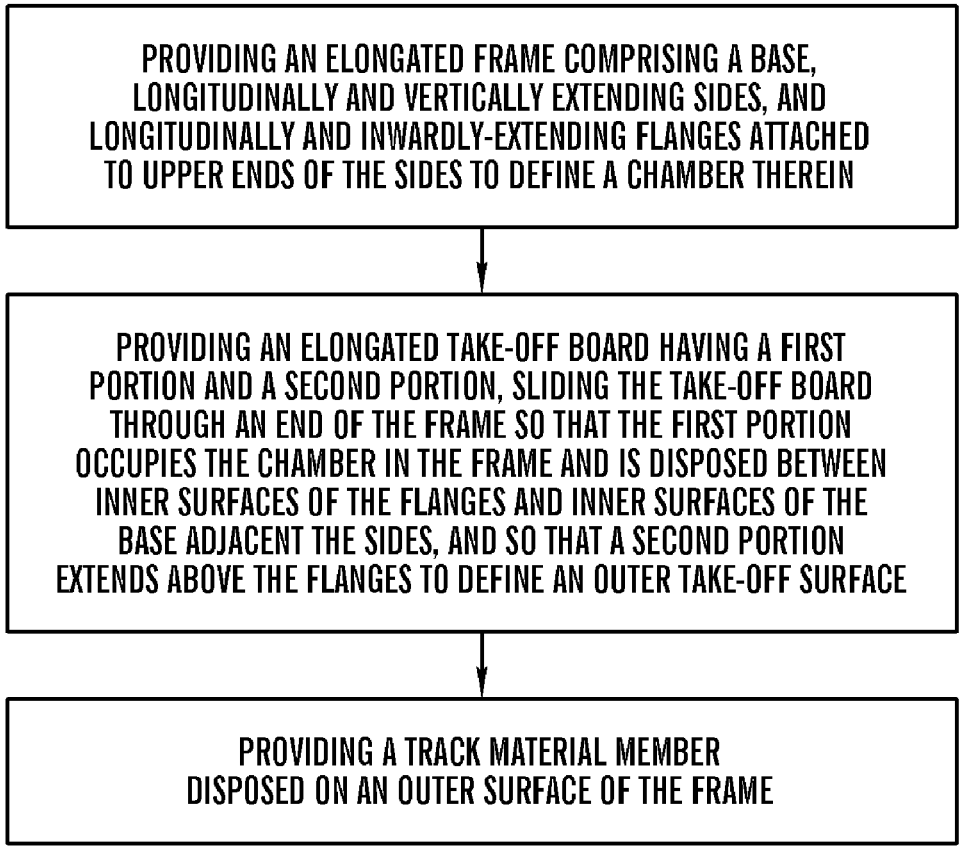
FIGS. 11 and 12 are flowcharts of methods for forming take-off board systems for a triple or long jump in accordance with aspects of the present invention.
Figure 12:
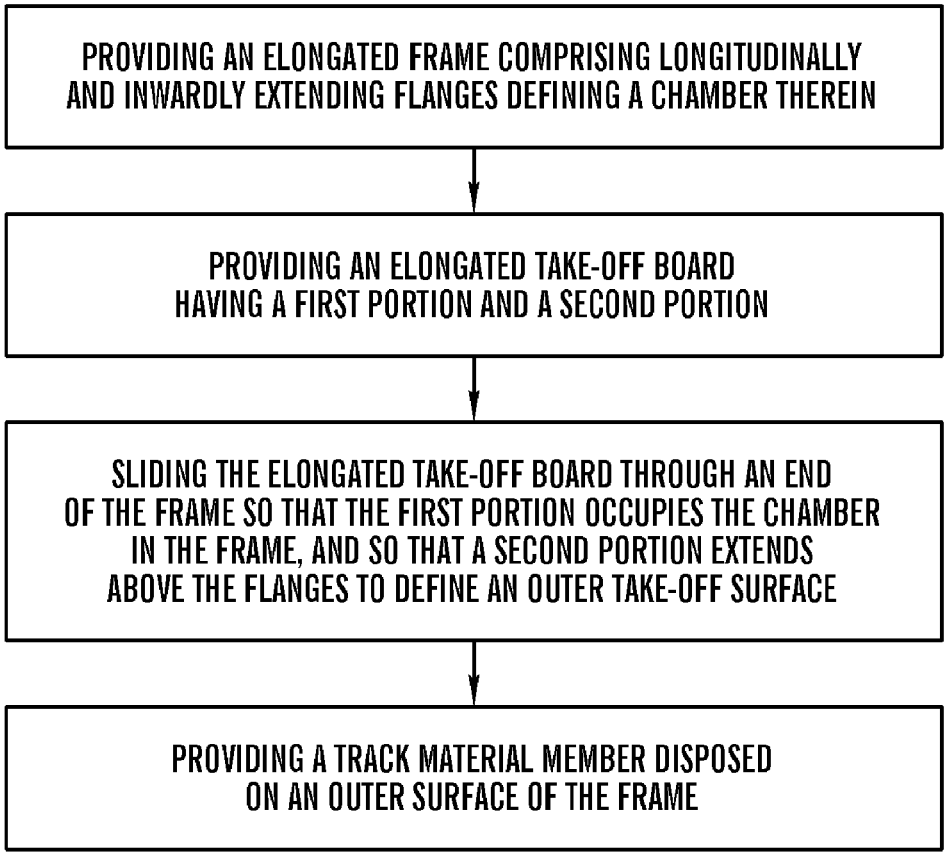
Figure 13:
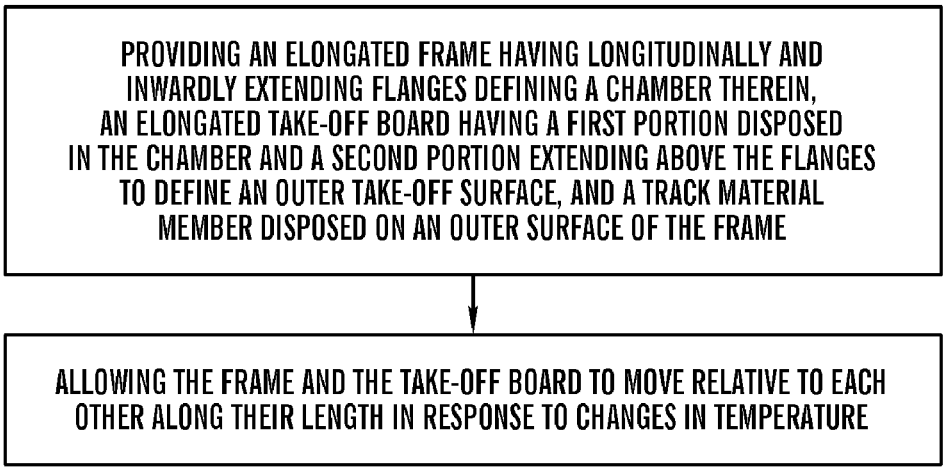
FIGS. 13 and 14 are flowcharts of methods for operating a take-off board system for a triple or long jump in accordance with aspects of the present invention.
Figure 14:
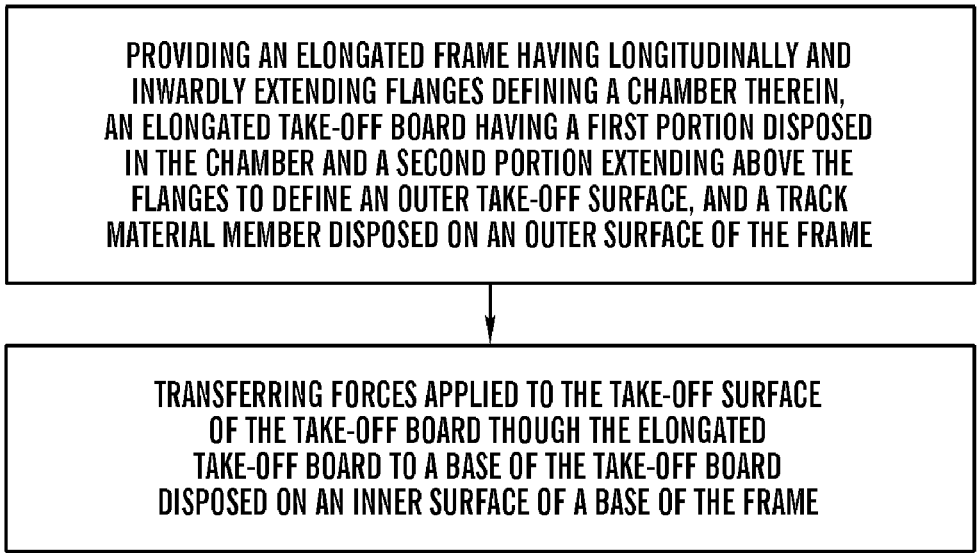

FIGS. 11 and 12 illustrate flowcharts of methods for forming take-off board systems for a triple or long jump in accordance with aspects of the present invention. FIGS. 13 and 14 illustrate flowcharts of methods for operating a take-off board system for a triple or long jump in accordance with aspects of the present invention.

Thus, while various embodiments of the present invention have been illustrated and described, it will be appreciated to those skilled in the art that many changes and modifications may be made thereunto without departing from the spirit and scope of the invention.

The invention claimed is:

1. A take-off board system for a triple or long jump, said take-off board system comprising:

an elongated frame comprising a base, longitudinally and vertically extending sides, and longitudinally and inwardly-extending flanges attached to upper ends of said sides to define a chamber therein;

an elongated take-off board comprising a first portion occupying said chamber in said frame and disposed between inner surfaces of said flanges and inner surfaces of said base adjacent said sides, and comprising a second portion extending above said inner surfaces of said flanges and an outer take-off surface;

a track material member disposed on an outer surface of said frame; and wherein said take-off board system disposable in a first position in a cavity in the ground with said outer take-off surface of said take-off board disposed even with a track surface, and said take-off board assembly disposable in a second position in the cavity in the ground with an outer surface of said track material member disposed even with the track surface.

2. The take-off board system of claim 1 further comprising a second elongated take-off board, said elongated take-off board being replaceable with said second elongated take-off board.

3. The take-off board system of claim 1 wherein said take-off board is slidably receivable through an end of the frame.

4. The take-off board system of claim 1 wherein the take-off board is slidably maintainable in said frame so that said take-off board and said frame are movable relative to each other along their length in response to changes in temperature.

5. The take-off board system of claim 1 further comprising elongated strips of track material member disposed along outer surfaces of said inwardly-extending flanges.

6. The take-off board system of claim 1 wherein the take-off board comprises longitudinally-extending sides having grooves in which are received said flanges of said frame.

7. The take-off board system of claim 1 wherein said take-off board comprises a solid take-off board.

8. The take-off board system of claim 7 wherein said take-off board comprises a single solid board.

9. The take-off board system of claim 1 wherein said take-off board supports the inner surfaces of said flanges.

10. The take-off board system of claim 1 wherein said frame comprises metal and said board comprises at least one of a synthetic material and an organic material.

11. The take-off board system of claim 1 further comprises a box defining the cavity and wherein the board assembly is receivable in the box.

12. The take-off board system of claim 1 further comprising elongated strips of track material member disposed along outer surfaces of said inwardly-extending flanges, and wherein said take-off board supports the inner surfaces of said flanges, and said take-off board is slidably maintainable in said elongated frame so that said take-off board is movable relative to the elongated frame along their length in response to changes in temperature.

13. The take-off board system of claim 12 wherein said take-off board comprises a solid board.

14. The take-off board system of claim 12 further comprises a box defining the cavity and wherein the board assembly is receivable in the box.

15. The take-off board system of claim 1 wherein the take-off board comprises longitudinally-extending sides having grooves in which are received said flanges of said frame, and wherein said take-off board supports the inner surfaces of said flanges, and said take-off board is slidably maintainable in said elongated frame so that said take-off board is movable relative to the frame along their length in response to changes in temperature.

16. The take-off board system of claim 15 wherein said take-off board comprises a solid board.

17. The take-off board system of claim 15 further comprises a box defining the cavity and wherein the board assembly is receivable in the box.

18. A take-off board system for a triple or long jump, said take-off board system comprising:

an elongated frame comprising longitudinally and inwardly extending flanges defining a chamber therein;

an elongated take-off board comprising a first portion slidably receivable in the chamber of the frame, and a second portion defining an outer take-off surface;

a track material member disposed on an outer surface of said frame; and wherein said take-off board system disposable in a first position in a cavity in the ground with said outer take-off surface of said take-off board disposed even with a track surface, and said take-off board assembly disposable in a second position in the cavity in the ground with an outer surface of said track material member disposed even with the track surface.

19. The take-off board system of claim 18 further comprising a second elongated take-off board, said elongated take-off board being replaceable with said second elongated take-off board.

20. The take-off board system of claim 18 wherein the take-off board is slidably maintainable in said frame so that said take-off board and said frame are movable relative to each other along their length in response to changes in temperature.

21. The take-off board system of claim 18 wherein said take-off board comprises a generally elongated rectangular cross-sectional shape having longitudinally-extending cut-outs along the upper corners.

22. The take-off board system of claim 18 wherein said take-off board comprises a generally elongated rectangular cross-sectional shape having longitudinally-extending grooves in which are received said inwardly-extending flanges of said frame.

23. A method for forming a take-off board system for a triple or long jump, the method comprising:

providing an elongated frame comprising a base, longitudinally and vertically extending sides, and longitudinally and inwardly-extending flanges attached to upper ends of the sides to define a chamber therein;

providing an elongated take-off board having a first portion and a second portion;

sliding the elongated take-off board through an end of the frame so that the first portion occupies the chamber in the frame and is disposed between inner surfaces of the flanges and inner surfaces of the base adjacent the sides, and so that the second portion extends above the inner surfaces of the flanges to define an outer take-off surface; and providing a track material member disposed on an outer surface of the frame.

24. The method of claim 23 wherein the providing the frame comprises providing the frame having a generally elongated rectangular cross-sectional shape having longitudinally-extending cutouts along the upper corners.

25. The method of claim 23 further comprising providing elongated strips of track material along outer surfaces of the inwardly-extending flanges.

26. The method of claim 23 wherein the providing the frame comprises providing the frame having a generally elongated rectangular cross-sectional shape having longitudinally-extending grooves in which are received the inwardly-extending flanges of the frame.

27. A method for forming a take-off board system for a triple or long jump, the method comprising:

providing an elongated frame comprising longitudinally and inwardly extending flanges defining a chamber therein;

providing an elongated take-off board having a first portion and a second portion;

sliding the elongated take-off board through and end of the frame so that the first portion occupies the chamber in the frame, and so that the second portion extends above inner surfaces of the flanges to define an outer take-off surface; and providing a track material member disposed on an outer surface of the frame.

28. The method of claim 27 further comprising removing the elongated take-off board from the elongated frame, providing a second elongated take-off board having a first portion and a second portion, and sliding the second elongated take-off board through an end of the frame so that the first portion occupies the chamber in the frame, and so that a second portion extends above the flanges to define an outer take-off surface.

29. The method of claim 27 wherein the providing the frame comprises providing the frame having a generally elongated rectangular cross-sectional shape having longitudinally-extending cutouts along the upper corners.

30. The method of claim 27 further comprising providing elongated strips of track material along outer surfaces of the inwardly-extending flanges.

31. The method of claim 27 wherein the providing the frame comprises providing the frame having a generally elongated rectangular cross-sectional shape having longitudinally-extending grooves in which are received the inwardly-extending flanges of the frame.

32. A method for operating a take-off board system for a triple or long jump, the method comprising:

providing an elongated frame having longitudinally and inwardly extending flanges defining a chamber therein, an elongated take-off board having a first portion disposed in the chamber and a second portion extending above inner surfaces of the flanges to define an outer take-off surface, and a track material member disposed on an outer surface of the frame; and allowing the frame and the take-off board to move relative to each other along their length in response to changes in temperature.

33. The method of claim 32 further comprising removing the elongated take-off board from the elongated frame, providing a second elongated take-off board having a first portion disposed in the chamber and a second portion extending above the flanges to define an outer take-off surface, and allowing the frame and the second take-off board to move relative to each other along their length in response to changes in temperature.

34. The method of claim 32 wherein the providing the frame comprises providing the frame having a generally elongated rectangular cross-sectional shape having longitudinally-extending cutouts along the upper corners.

35. The method of claim 32 wherein the providing the frame comprises providing the frame having a generally elongated rectangular cross-sectional shape having longitudinally-extending grooves in which are received the inwardly-extending flanges of the frame.

36. A method for operating a take-off board system for a triple or long jump, the method comprising:

providing an elongated frame having longitudinally and inwardly extending flanges defining a chamber therein, an elongated take-off board having a first portion disposed in the chamber and a second portion extending above inner surfaces of the flanges to define an outer take-off surface, and a track material member disposed on an outer surface of the frame; and transferring forces applied to the take-off surface of the take-off board though the elongated take-off board to a base of the take-off board which is disposed on an inner surface of a base of the frame.

37. The method of claim 36 further comprising removing the elongated take-off board from the elongated frame, providing a second elongated take-off board having a first portion disposed in the chamber and a second portion extending above the flanges to define an outer take-off surface, and transferring forces applied to the take-off surface of the second take-off board though the second elongated take-off board to the base of the second take-off board which is disposed on the inner surface of the base of the frame.

38. The method of claim 36 wherein the providing the frame comprises providing the frame having a generally elongated rectangular cross-sectional shape having longitudinally-extending cutouts along the upper corners.

39. The method of claim 36 wherein the providing the frame comprises providing the frame having a generally elongated rectangular cross-sectional shape having longitudinally-extending grooves in which are received the inwardly-extending flanges of the frame.

* * * * *